US005680684A

United States Patent [19]

Musha et al.

[11] Patent Number: 5,680,684

[45] Date of Patent: Oct. 28, 1997

[54] AIR INTERMINGLING METHOD AND AIR INTERMINGLING MACHINE EMPLOYING A 1/F FLUCTUATION

[75] Inventors: Toshimitsu Musha, 13-17, Minami-Tsukushino 2-chome, Machida-shi, Tokyo; Yuichi Yanai, Okazaki; Kazuyoshi Muraoka, Osaka; Yuki Niwa, Okazaki, all of Japan

[73] Assignees: Toshimitsu Musha; Nisshinbo Industries Inc., both of Tokyo, Japan

[21] Appl. No.: 445,701

[22] Filed: May 22, 1995

[30] Foreign Application Priority Data

May 24, 1994 [JP] Japan ..... 6-133795

[51] Int. Cl.[6] ..... D02G 1/16; D02J 1/08

[52] U.S. Cl. ..... 28/271; 57/350; 57/908

[58] Field of Search ..... 28/217, 218, 219, 28/243, 247, 252, 271, 272–273, 274, 275, 276; 57/350, 333, 9

[56] References Cited

U.S. PATENT DOCUMENTS

| | | | |
|---|---|---|---|
| 1,988,977 | 1/1935 | Andrews | 139/192 |
| 2,048,001 | 7/1936 | Fish | 139/192 |
| 2,643,684 | 6/1953 | Taylor | 139/192 |
| 3,018,801 | 1/1962 | Coon et al. | 139/29 |
| 3,638,297 | 2/1972 | Ditscherlein | 139/192 |
| 3,805,344 | 4/1974 | Bartnicki et al. | 28/252 |
| 3,835,511 | 9/1974 | Schradel et al. | 28/252 |
| 3,952,386 | 4/1976 | Joly et al. . | |
| 4,038,811 | 8/1977 | Ansin et al. | 28/252 |
| 4,058,968 | 11/1977 | Benson . | |
| 4,059,950 | 11/1977 | Negishi et al. | 57/206 |
| 4,495,244 | 1/1985 | Phillips | 57/206 |
| 4,495,560 | 1/1985 | Sugimoto et al. | 364/154 |
| 4,685,179 | 8/1987 | Sheehan et al. | 28/252 |
| 4,782,565 | 11/1988 | Sheehan et al. | 28/252 |
| 5,056,200 | 10/1991 | Schwartz et al. | 28/252 |
| 5,243,267 | 9/1993 | Ogasawara . | |

FOREIGN PATENT DOCUMENTS

| | | |
|---|---|---|
| 549264 | 4/1932 | Denmark . |
| 0260062 | 3/1988 | European Pat. Off. . |
| 327950 | 4/1902 | France . |
| 1490531 | 11/1967 | France . |
| 1527342 | 12/1989 | U.S.S.R. . |
| 2022871 | 12/1979 | United Kingdom . |

OTHER PUBLICATIONS

Journal of Japan, Soc. of Precision Machinery vol. 50, No. 6, 1985 'Bioinformation and i/f Fluctuation' *the whole document*.

"Biological Signals—Actual Measurement and Analysis—", 1989, Corona Publishing Co.

"Physics of the Living State", Ohmsha, 1994.

"Noise in Physical Systems and 1/f Fluctuations" World Scientific, May 29, 1995–Jun. 3, 1995.

"Computer Analysis of cardiovascular signals Chapter 6 1/f Fluctuations of the Biological Rhythm", *1/f Fluctuations of the Biological Rhythm* IOS Press, 1995.

London, Derwent Publications Ltd., AN 94–045881.

*Primary Examiner*—C. D. Crowder

*Assistant Examiner*—Larry D. Worrell, Jr.

*Attorney, Agent, or Firm*—Nikaido, Marmelstein, Murray & Oram LLP

[57] ABSTRACT

A method for intermingling yarn, and an air intermingling machine 1 used therein, is provided that yields yarn with the comfortable feel of hand-spun yarn, on an industrial scale. In the air intermingling machine 1, intermingling is imparted to the yarn by signals having a 1/f fluctuation, wherein the degree of intermingling of the yarn vanes with a 1/f fluctuation provides a natural, comfortable feel.

3 Claims, 3 Drawing Sheets

AIR INTERMINGLING METHOD AND AIR INTERMINGLING MACHINE EMPLOYING A 1/F FLUCTUATION

BACKGROUND OF THE INVENTION

This invention relates to an air intermingling process which imparts an irregularity having a 1/f fluctuation to the yarn entwinings.

A method to produce interlaced yarn was disclosed by the Dupont Corporation in the publication of examined Japanese Patent application number 32(1957)-12230. Also known as air intermingled yarn, it is now commonly used to prevent some problems in subsequent weaving and knitting processes. In recent years, with the development of various types of long fibers, and composite fibers thereof, air intermingled yarn is being used to produce irregular knitted fabrics, and air intermingling is now an established technique for processing yarn.

Convention intermingling process have suffered from the following problems.

1. Conventional air intermingled yarn is interlaced yarn produced from filaments, and has very little bulk and a hard feel.

2. Conventional air intermingled yarn does not have a natural irregular feel, and is not very comfortable to the wearer.

SUMMARY AND OBJECTS OF THE INVENTION

The objective of this invention is to provide a yarn with high bulk and a soft feel.

Another objective of this invention is to provide an intermingled yarn having a 1/f correlation and a natural irregular feel that is comfortable for the wearer, which can be produced on an industrial scale.

Another objective of this invention is to provide a yarn that incorporates a melody or musical sound with a 1/f fluctuation.

In the description of this invention, a "1/f fluctuation" is defined as a power spectrum, with a frequency component f, and proportional to $1/f^k$, where k is approximately 1, and is defined as a power spectrum which is similar to the above.

One of the present inventors, Toshimitsu MUSHA, was the first in the world to discover that a 1/f fluctuation would impart a particularly comfortable feel to humans. The results were published in a paper entitled "Seitai Seigyo to 1/f Yuragi" [Biocontrol and 1/f Fluctuation], Journal of Japan Society of Precision Machinery, 1984, Vol. 50, No. 6, and another paper entitled "Seitai Joho to 1/f Yuragi" [Bioinformation and 1/f Fluctuation], Applied Physics, 1985, pp. 429–435, as well as in a recent publication called "Yuragi no Hassou" [The concept of Fluctuations], published by NHK publishers in 1994. The abstract of these publications read:

> The 1/f fluctuation provides a comfortable feeling to humans; the reason being that the variations in the basic rhythm of the human body have a 1/f spectrum. From another perspective, the human body eventually tires of a constant stimulation from the same source, but conversely, the body feels uncomfortable if the stimulations were to change too suddenly; therefore a 1/f fluctuation is a fluctuation of the right proportion between these two extremes.

In addition, an excerpt from "Yuragi no Sekai" [The World of Fluctuations], published by Kodansha Publishers, reads:

> For example, the rhythms exhibited by the human body such as heart beats, hand-clapping to music, impulse-release period of neurons, and α-rhythms observed in the brain, are all basically 1/f fluctuations, and it has been shown experimentally that if a body is stimulated by a fluctuation like these biorhythmic 1/f fluctuations, it would feel comfortable. Fluctuations (variations) exist in various forms throughout nature, but the murmur of a brook, a breath of wind, and other phenomena that impart a comfortable feeling to humans have a 1/f fluctuation, while typhoons and other, strong winds that impart uneasiness do not have a 1/f fluctuation.

This invention solves the past problems and is effective as follows:

1. The intermingling of the yarn does not change randomly, rather the change has a correlation, specifically a correlation with a 1/f fluctuation, thus imparting to the yarn a special aesthetic beauty and wearing comfort.

2. Intermingling can be applied to spun yarn, or combinations of filaments and spun yarn, or spun yarn and spun yarn, which increases the bulk of the yarn, thus producing a soft feel.

3. Yarn with a natural irregular feel of hand-spun yarn can be machine-spun on an industrial scale, at low cost.

4. In intermingling the yarn, the speed at which the yarn is fed and the pressure of the compressed air fed to the air-jet nozzle is not varied at random, but rather with a correlation, specifically, a correlation with a 1/f fluctuations which produces a yarn or fabric or knitted fabric with a more natural irregular feel.

5. A melody or sound having a 1/f fluctuation is incorporated into the yarn, which imparts to the yarn or fabric more wearing comfort.

DETAILED DESCRIPTION OF THE DRAWINGS

The above and other objects and the attendant advantages of the present invention will become readily apparent by reference to the following detailed description when considered in conjunction with the accompanying drawings wherein.

DETAILED DESCRIPTION OF A PREFERRED EMBODIMENT OF THE INVENTION

A working example of this invention will be explained below using the drawings.

This invention imparts a variation having a 1/f fluctuation during the entwining of yarn 3 to produce a machine spun yarn having a feel similar to hand spun yarn, and which can be manufactured in large quantities using mechanical equipment. The invention can be applied to all general types of spun yarn (natural fibers, chemical fibers, synthetic fibers, and others) and filaments (natural fibers, chemical fibers, synthetic fibers, and others). Those of ordinary skill in the art will recognize that the invention is not limited to the examples set forth above and below and may be modified accordingly.

1. Air Intermingling Machine

Figure 1:
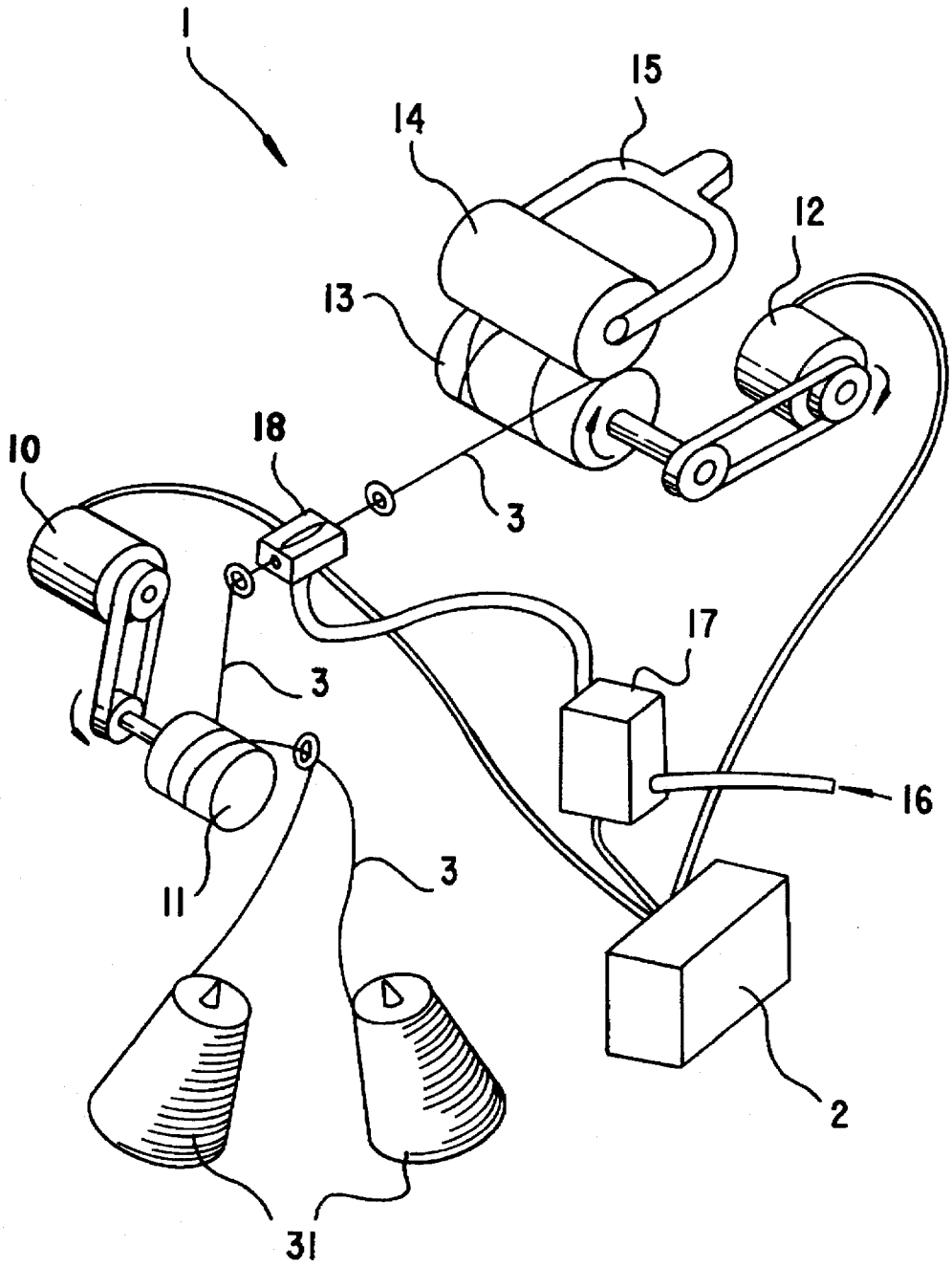
FIG. 1 is a conceptual diagram of an air intermingling machine.

The air intermingling machine 1 is a device that entwines one or several threads of yarn 3 to produce air intermingled yarn. As shown in the conceptual drawing of FIG. 1, the air intermingling machine is equipped with several motors; for example, feed motor 10, and drum motor 12. Each motor can be controlled independently. However, the feed speed must be equal to or greater than the drum take-up speed, with a maximum difference of 8%. Feed motor 10 is used to drive the feed roller 11. For example, the rotational speed of the feed roller 11 can be determined by imparting a prescribed rotational speed to feed roller 11 via a belt and gears, and adjusting the size of the pulleys and gears. As well, any arbitrary speed can be imparted to the drum using drum motor 12. Also, the motors can be used in common where necessary, and the rotational speed of the feed roller and drum can be adjusted using belts, gears, or other converters.

An air-jet nozzle 18 provides a turbulent air jet to entwine the yarn, which is the main objective of this machine, and an air pressure regulator 17 controls, by an applied voltage (or current), the pressure of the compressed air fed to the air-jet nozzle 18.

The intermingled yarn so formed is supported by cradle 15 and oscillates back and forth with the rotation and grooves of the grooved drum 13, and wound onto the bobbin abutting the grooved drum 13 to form the cheese 14.

An air intermingling control device 2 is provided to control the feed motor 10, drum motor 12 and air pressure regulator 17.

2. Feed Roller and Drum

Feed roller 11 rotates at a prescribed speed and takes in one thread or several threads of yarn 3 wound on bobbin 31. For this, the yarn is wound around the feed roller 11, which is then rotated. The yarn take-in speed is determined by the diameter and rotational speed of the feed roller 11. The yarn then let-off by the feed roller 11 passes through the air-jet nozzle 18, and is taken up onto a separate bobbin by means of the grooved drum 13, to form the cheese 14.

3. Air-jet Nozzle, Air Pressure Regulator

Compressed air is fed from the compressor 16 to the air-jet nozzle 18 at a prescribed pressure by means of the air pressure regulator 17. An applied voltage (current) to the pressure regulator 17 provides a stepless control of the pressure of between 0.5–6.0 kg/CM2. The degree of intermingling is determined by the length of the yarn let-off from the feed roller 11 during a set time interval, and the number of interminglings imparted in that interval. The number of interminglings is defined as the number of entwined areas per fixed length of yarn, and varies with the pressure of the compressed air from the air-jet nozzle 18. Accordingly, the degree of intermingling can be adjusted by fixing either the length of the yarn being let-off or the pressure of the compressed air, and varying the other parameter. In other words, intermingling can be increased by fixing the length of the yarn being let-off from the feed roller 11, and increasing the air pressure of the air-jet nozzle 18; or by maintaining a constant pressure from the air-jet nozzle 18 while reducing the length of the yarn being let-off from the feed roller 11. Either method achieves the same result.

3. 1/f Fluctuation Signal

The 1/f fluctuation signal is derived from $Y_1, Y_2, Y_3, \ldots$ formed by multiplying n coefficients, $a_1, a_2, a_3, \ldots, a_n$, on numbers, $X_1, X_2, X_3, \ldots$. Generally, $Y_j$ can be expressed by the following equation. Here, the sequence of numerical values forming $Y_1, Y_2, Y_3, \ldots$ has a 1/f spectrum, (For further details, refer to Seitai shingou (Biological Signaling), Chapter 10, "Biological Rhythms and Fluctuations," published by Corona Publishers, Ltd. in 1989)

$$y_j = x_j + \left(\frac{1}{2}\right) x_{j-1} + \left(\frac{1*3}{2^2*2!}\right) x_{j-2} + \left(\frac{1*3*5}{2^3*3!}\right) x_{j-3} + \ldots \left(\frac{1*3*5*\ldots*(2n-1)}{2^{n-1}*(n-1)!}\right) X_{j+n+1} \quad (1)$$

4. 1/f Fluctuation Signal Generator

In the 1/f-fluctuation signal generator, step 1 generates a sequence of random numbers using, for example, a computer. In step 2, a certain number, n, of coefficients, a, stored in a storage device, are successively multiplied on the random numbers, and then a sequence of numerical values, Y, is obtained by a linear transformation.

This numerical sequence has a 1/f spectrum, therefore it is converted into an electrical signal as a 1/f fluctuation signal and output to the motor control signal. For example, large values in the numerical sequence can be set to correspond to a high electric potential to increase the speed of the motors, thereby increasing the degree of intermingling. Other methods can also be employed, such as numerical control to control the rotational frequency of the motors using values from the numerical sequence. And if, for example, the inertia of the motors and other components of the control system is large, the level of the 1/f fluctuation control signal can be reduced as necessary.

5. Creating a Melody Having a 1/f-Fluctuation

Figure 2:
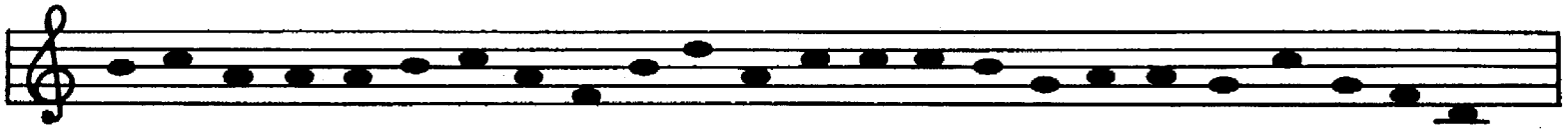
FIG. 2 illustrates a portion of a melody with a 1/f fluctuation.

To create a melody using Equation 1 for a sequence of numerical values, Y, having a 1/f sequence, first, the scale and the range (lowest frequency fL and highest frequency fU) are determined. A 1/f sequence Y is derived, and a transformation is performed so that the upper and lower limits become the lowest frequency fL and highest frequency fU respectively. The values of the sequence Y so derived are regarded as acoustic frequencies, and are substituted for the music scale they most closely approximate. In other words, they are arranged, for example, as quarter notes, between or on the lines of a staff on music paper, FIG. 2 shows a portion of a melody derived using this method. The pitch and duration of the notes of the arranged melody are set to correspond to the rotational speed of the motor and the duration of that speed, thereby controlling the motor, and expressing the melody in the intermingling of the yarn.

6. Generating Control Signals from Sounds Having a 1/f Fluctuation

The acoustic frequency fluctuation of the sound of the murmur of a brook, the music of J. S. Bach, and the music of W. A. Mozart have a 1/f fluctuation. Accordingly, a recording or live performance of these sounds is sampled at a constant interval, for example, every 25 ms, and the mean acoustic frequency is given by the number of zero-crossings of the sound wave-form, and this number is converted to a number per unit of time. The sequence of average frequencies so obtained is mapped as musical notes, which can then be used as signals required for motor control. The relationship between music and a 1/f fluctuation is described in Yuragi no Sekai (The World of Fluctuation), published by Kodansha Publisher, and Mugen, kaosu, yuragi (Infinity, Chaos and Fluctuation) published by Baifukan in 1985.

7. Control of Motors and Compressed Air

Figure 3:
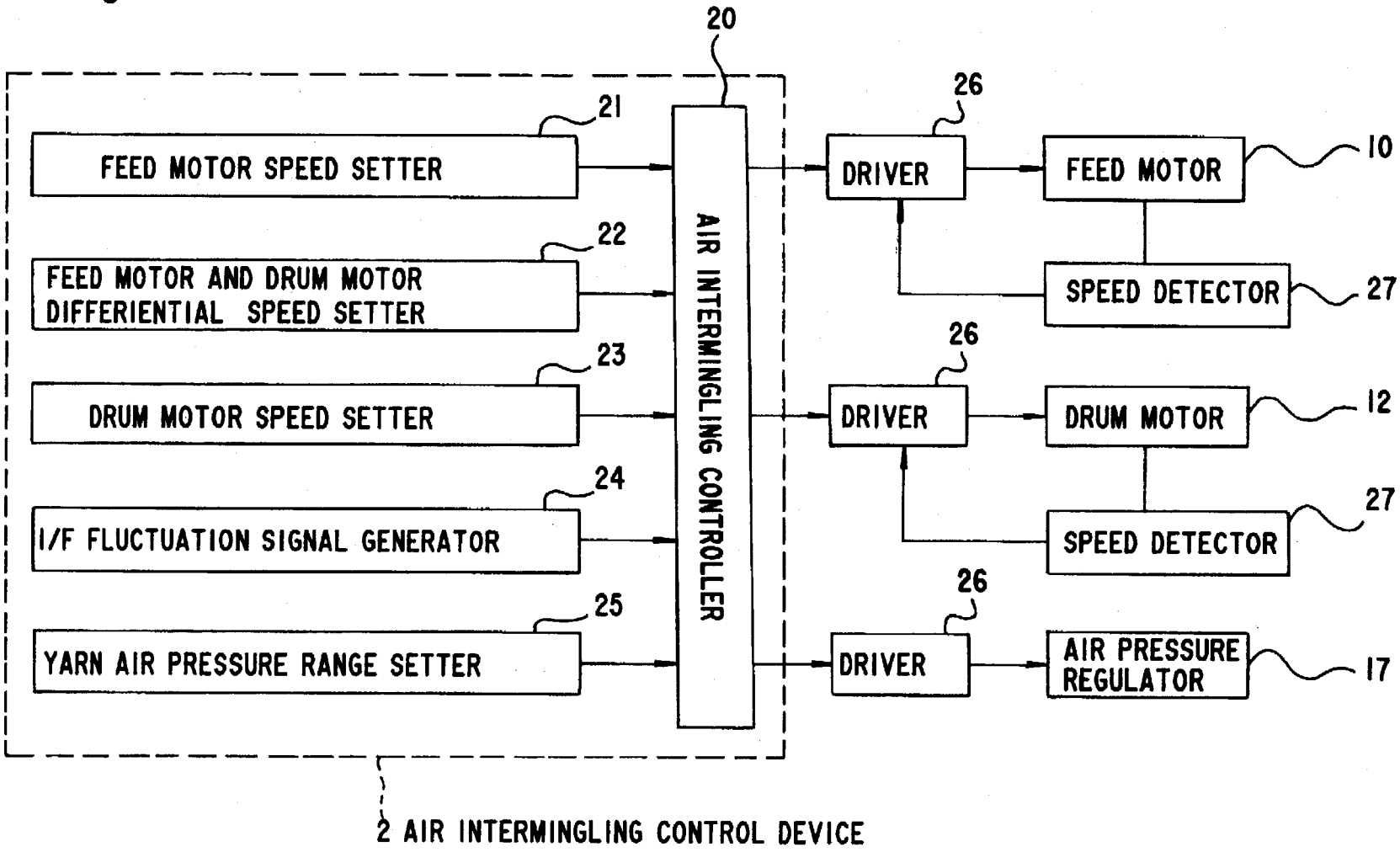
FIG. 3 is a block diagram of the control of the air intermingling machine.

The control of each motor used in entwining the yarn and the control of the air pressure regulator 17 is shown in the block diagram of FIG. 3. Signals from the feed motor speed setter 21, feed motor and drum motor differential speed setter 22, drum motor speed setter 23, 1/f fluctuation signal generator 24, and the yarn air pressure range setter 25 are processed by the controller 20 to control, by means of drivers 26, the feed motor 10, drum motor 12, and air pressure regulator 17. The rotational speed of each motor is controlled by feedback from a speed detector 27. A prescribed speed can be set for each motor using the respective motor speed setter 27, and a 1/f fluctuation can be imparted to the rotational speed of each motor by applying signals from the 1/f signal generator 24 to the speed detector 27. However, the yarn feed speed must be equal to or greater than the take-up speed, otherwise, if the take-up speed is greater, then the yarn will break, the feed motor and drum motor speed differential setter is used to control the difference between the two speeds to a maximum allowable difference of 8%, which has been verified by experiments.

Alteratively, the yarn air pressure range setter 25 can be used to set the degree of intermingling in the yarn, in which case a 1/f fluctuation is imparted to the change in the air pressure, thereby obtaining an intermingled yarn 3 which has a 1/f fluctuation.

8. Control of Intermingling

A 1/f fluctuation can be imparted to the yarn by maintaining a constant air pressure from the air pressure regulator 17 while controlling the feed motor 10 and drum motor 12, the effect of which will be to vary the intermingling. For example, by imparting a 1/f fluctuation to the take-in speed of the yarn of the feed roller 11, the degree of intermingling of the yarn will vary between heavy to slight, with a correlation of a 1/f fluctuation. This take-in speed of the feed roller 11 can be adjusted by controlling the rotational speed of said feed roller. The feed motor and drum motor differential speed setter can be used to control the rotational speed of the drum motor 12, thereby adjusting the rotation of the drum. Accordingly, a 1/f fluctuation can be imparted to the intermingling of the yarn by applying a 1/f fluctuation signal to the rotational speed of the feed motor 10, and maintaining a constant air pressure from the air pressure regulator 17.

Alternatively, the rotational speed of the feed roller 11 can be kept constant, and a 1/f fluctuation signal can be imparted to the air pressure of the air pressure regulator 17.

As well, a 1/f fluctuation can be imparted by controlling the feed motor and drum motor, and the air pressure of the air pressure regulator 17 simultaneously.

It is readily apparent that the above-described has the advantage of wide commercial utility. It should be understood that the specific form of the invention hereinabove described is intended to be representative only, as certain modifications within the scope of these teachings will be apparent to those skilled in the art.

Accordingly, reference should be made to the following claims in determining the full scope of the invention.

We claim:

1. An air intermingling method comprising:

imparting a degree of intermingling to at least one thread of a yarn;

providing a series of signals having a 1/f fluctuation; and varying the degree of imparted intermingling to said yarn corresponding to a varying strength of the series of signals having 1/f fluctuation.

2. An air intermingling machine for imparting intermingling to at least one thread of a yarn, comprising:

a feed roller for leading in yarn;

an air-jet nozzle operationally attached to a pressure regulator and having a pressure, the yarn from the feed roller passing through said nozzle;

a grooved drum for taking up the yarn; and wherein a pressure of the air-jet nozzle is set to correspond to a varying strength of a series of signals having a 1/f fluctuation, thereby imparting an intermingling to the yarn which varies with a correlation of a 1/f fluctuation.

3. An air intermingling machine for imparting intermingling to at least one thread of a yarn, comprising:

a feed roller for a leading in yarn;

an air-jet nozzle operationally attached to a pressure regulator, the yarn from the feed roller passing through said nozzle;

a grooved drum for taking up the yarn; and wherein a rotational frequency of the feed roller is set to correspond to a varying strength of a series of signals having a 1/f fluctuation to vary a speed of the yarn, thereby imparting an intermingling to the yarn which varies with a correlation of a 1/f fluctuation.

* * * * *